US008100489B2

(12) United States Patent
Timm, Jr. et al.

(10) Patent No.: US 8,100,489 B2
(45) Date of Patent: Jan. 24, 2012

(54) DOUBLE-SIDED PRINTING SYSTEM

(75) Inventors: Dale D. Timm, Jr., Solano Beach, CA (US); John A. Dangelawicz, San Diego, CA (US); David H. Donovan, San Diego, CA (US); Shilin Guo, San Diego, CA (US); Behnam Baslani, San Diego, CA (US); David Luis Pereira, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 659 days.

(21) Appl. No.: 12/253,388

(22) Filed: Oct. 17, 2008

(65) Prior Publication Data

US 2009/0153605 A1 Jun. 18, 2009

Related U.S. Application Data

(60) Provisional application No. 61/007,606, filed on Dec. 12, 2007.

(51) Int. Cl.
*B41J 2/01* (2006.01)
*B41J 3/00* (2006.01)

(52) U.S. Cl. ..... 347/2; 347/103

(58) Field of Classification Search ..... 347/2, 103, 347/105, 173

See application file for complete search history.

(56) References Cited

U.S. PATENT DOCUMENTS

| | | | | |
|---|---|---|---|---|
| 6,203,131 | B1 * | 3/2001 | Wiklof | 347/2 |
| 6,599,226 | B2 | 7/2003 | Asai et al. | |
| 6,666,443 | B2 | 12/2003 | Shida et al. | |
| 6,759,366 | B2 * | 7/2004 | Beckerdite et al. | 503/200 |
| 7,073,436 | B2 | 7/2006 | Takahashi | |
| 2002/0135791 | A1 | 9/2002 | Rodriquez | |
| 2003/0063179 | A1 * | 4/2003 | Adachi | 347/141 |
| 2006/0268293 | A1 | 11/2006 | Lapstun et al. | |
| 2007/0041765 | A1 | 2/2007 | Makino | |
| 2007/0085869 | A1 | 4/2007 | Hirano et al. | |
| 2007/0110277 | A1 | 5/2007 | Hayduchok et al. | |

FOREIGN PATENT DOCUMENTS

| | | |
|---|---|---|
| JP | 2002240231 | 8/2002 |

* cited by examiner

*Primary Examiner* — Hai C Pham

(57) ABSTRACT

A method for double-sided printing may include ejecting printing fluid from a fluid ejector to a platen configured to receive print media, the platen supporting a nonabsorbent substrate. In any sequence, a first print media side and a second print media side may be printed by ejecting printing fluid from the fluid ejector to the first print media side, and contacting the second print media side with the nonabsorbent substrate to transfer printing fluid from the nonabsorbent substrate to the second print media side. A method for double-side printing may further include increasing the contact between the second print media side with the nonabsorbent substrate to increase transfer of printing fluid.

20 Claims, 3 Drawing Sheets

DOUBLE-SIDED PRINTING SYSTEM

CROSS-REFERENCES TO RELATED APPLICATIONS

This Application claims the benefit of provisional patent application Ser. No. 61/007,606, filed Dec. 12, 2007, titled "DOUBLE-SIDED PRINTING SYSTEM", which application is incorporated by reference herein as if reproduced in full below.

The present application is related to co-pending U.S. patent application Ser. No. 12/253,360 filed on the same day herewith by John A. Dangelewicz and Geoffrey F. Schmid and entitled MEDIA SUPPORT PICK DEVICE, the full disclosure which is hereby incorporated by reference. The present application is related to co-pending U.S. patent application Ser. No. 12/253,321 filed on the same day herewith by John A. Dangelewicz and Dale D. Timm, Jr. and entitled TRAY SURFACE CLEANING DEVICE, the full disclosure which is hereby incorporated by reference. The present application is related to co-pending U.S. patent application Ser. No. 11/625,032 filed on Jan. 19, 2007 by Geoffrey F. Schmid and Kevin T. Kersey an entitled VACUUM RELIEF, the full disclosure which is hereby incorporated by reference. The present application is related to co-pending U.S. patent application Ser. No. 11/133,539 filed on May 20, 2005 by John A. Dangelewicz, Kevin T. Kersey, Timothy J. Carlin, Geoffrey F. Schmid and Michael A. Novick an entitled SHEET HANDLING, the full disclosure which is hereby incorporated by reference.

BACKGROUND

Many methods for double-sided printing involve adding a supplemental device to a printing system in order to accomplish the task. These supplemental devices, in turn, add cost and complexity to the printing system, and may increase the likelihood of media jams and ink smears. Additionally, such devices may lengthen the time required to complete printing, and thus may reduce printer throughput.

In some printing systems, double-sided printing is accomplished using a mechanical flipper, which flips sheet media after printing on a first side to accommodate printing on a second side. A printing system thus may be configured to pass a sheet through a printing station for printing on one side, flip the sheet, pass the sheet through the print station again for printing on the other side, and then expel the sheet. Unfortunately, for some types of printing fluid or print media, this may involve sheet processing while printing fluid is still wet, and thus may cause undesirable printing artifacts, such as smearing or running of printing fluid on the sheet. Furthermore, the time required for printing, and the potential for media jam, may be increased due to manipulation of the sheet for the second pass through the print station.

Printing systems also may employ printheads on opposite sides of a media path so as to accommodate printing on both sides of media during a single pass through the print station. Such arrangements, however, add to the cost and complexity of a printing system, and may increase the size and/or footprint of a printing system.

BRIEF DESCRIPTION OF THE DRAWINGS

FIG. 5 is a sectional view of a platen and a pick plate with print media disposed there between.

FIG. 6 is a sectional view of a platen and a pick plate with print media disposed there between.

FIG. 7 is a sectional view of a platen and a pick plate with print media disposed there between.

FIG. 8 is a sectional view of a platen and a pick plate with print media disposed there between.

DETAILED DESCRIPTION

As described herein, a printing system may refer to any system including a fluid ejector that can generate an image (e.g., a letter, a picture, a drawing, etc.) on print media, such as paper, plastic, fabric, etc. Correspondingly, a printing system may include a fluid ejector of any type suitable for placement of printing fluid, such as ink, on print media. A method for double-sided printing according to the present disclosure may include ejecting printing fluid from a fluid ejector to a platen supporting a nonabsorbent substrate. The nonabsorbent substrate may deposit the received printing fluid on a second, or backside, of print media. Printing of a first or front side of print media may occur directly.

Figure 1:
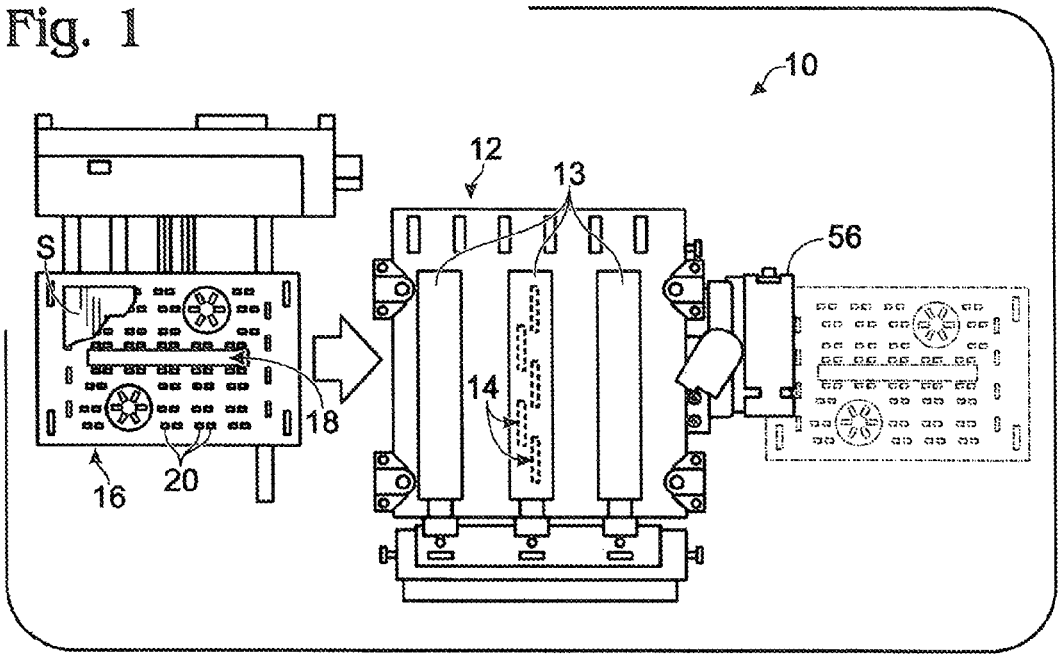
FIG. 1 is a top view of a printing system in accordance with the present disclosure, showing a fluid ejector, a platen, and a nonabsorbent substrate.

Referring initially to FIG. 1, an exemplary printing system 10 is shown, the depicted printing system forming a part of an inkjet printer for use in depositing images on print media such as sheet media S. As indicated, printing system 10 may include a fluid ejection subsystem 12 with one or more print cartridges 13. Each print cartridge 13 may further include one or more printheads 14. Printheads 14 may include one or more fluid ejectors 15 (FIG. 2) configured to selectively eject printing fluid, including, but not limited to, ink. In accordance with the present disclosure, fluid ejectors 15 may be configured to eject printing fluid to produce a forward-image and/or to produce a reverse-image.

Figure 2:
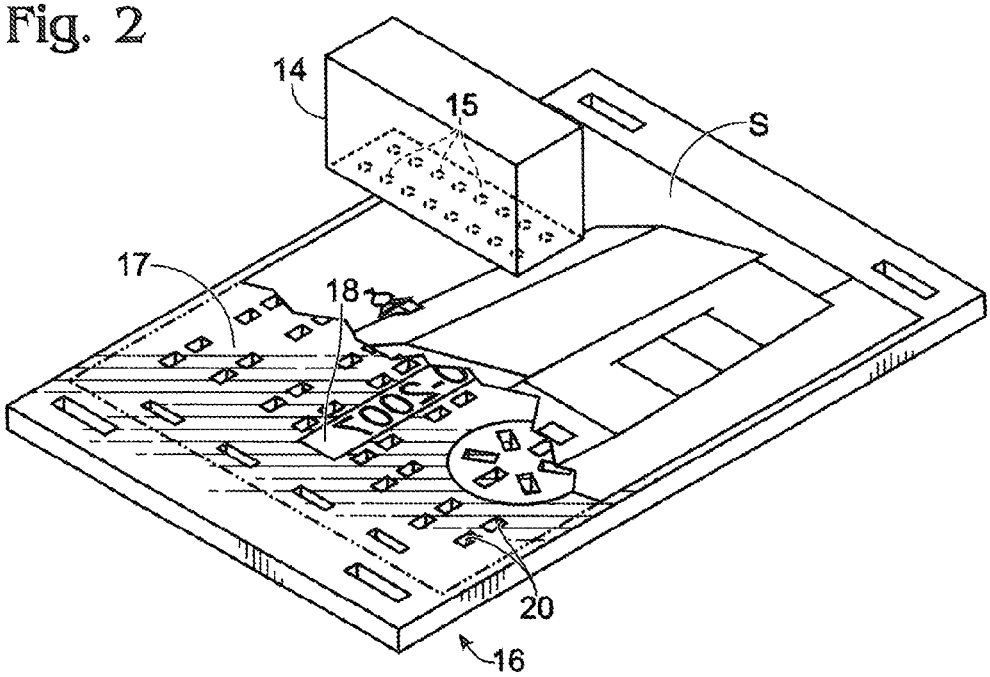
FIG. 2 is a perspective view of a platen in accordance with the present disclosure, showing a section of print media disposed on the platen.

As shown in FIGS. 1 and 2, a platen 16 may be configured to receive a media sheet S for placement in defined relation to fluid ejectors 15, such that an image may be deposited on both sides of media sheet S. In accordance with the present teachings, platen 16 may support a nonabsorbent substrate 18. Nonabsorbent substrate 18 may be integral with platen 16, or may be placed on or in platen 16 in close association therewith. Nonabsorbent substrate 18 may be formed of virtually any material configured to receive printing fluid from the fluid ejectors 15, and to transfer the received printing fluid to another, more absorbent, material, such as sheet media S. In some examples, nonabsorbent substrate 18 may be a low surface-energy material, such as Teflon or glass.

In some examples of a printing system 10, platen 16 and nonabsorbent substrate 18 may be configured to receive print media, such as sheet media S, on a planar surface. Alternatively, platen 16 and nonabsorbent substrate 18 may be configured to receive print media on a curved surface, such as a roller. Platen 16 may be further configured to increase contact between sheet media S and nonabsorbent substrate 18 using retention mechanisms. Referring to the embodiment in FIGS. 1 and 2, platen 16 may include retention mechanisms, such as vacuum ports 20, to retain, or suction, sheet media S to nonabsorbent substrate 18. As shown in FIGS. 1 and 2, vacuum ports 20 may be placed in close relation in the area of platen 16 supporting nonabsorbent substrate 18, thereby further increasing contact between print media and nonabsorbent substrate 18.

The size and location of nonabsorbent substrate 18 in relation to platen surface 17 may be dependant on the location and size of the print media, or the image to be transferred to print media. For example, as shown in FIGS. 1 and 2, nonabsorbent substrate 18 may be supported at a central location of platen surface 17, and, further, may be sized to cover less than 25% of platen surface 17. Alternatively, nonabsorbent substrate 18 may cover substantially all, or over 85%, of platen surface 17.

Figure 3:
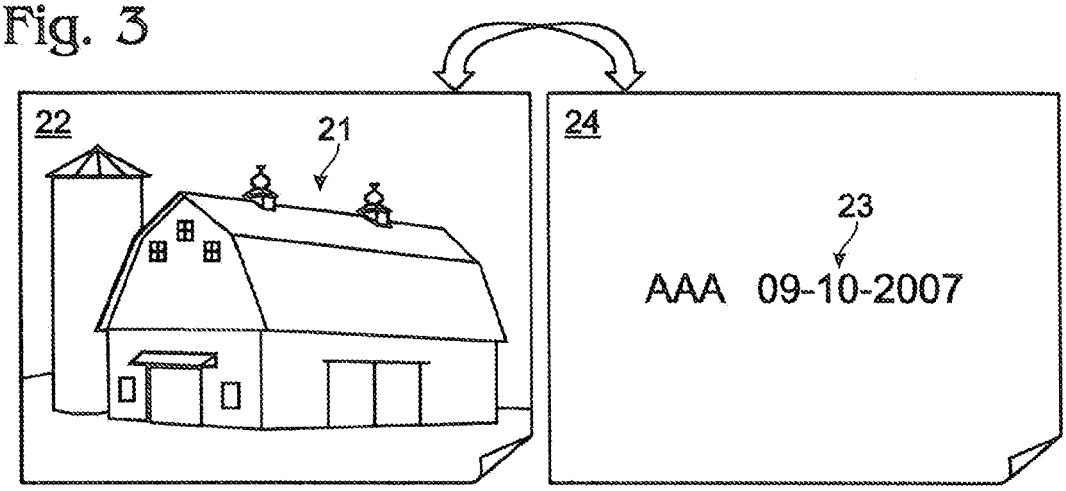
FIG. 3 illustrates opposite sides of a print media sheet after printing.
Figure 4:
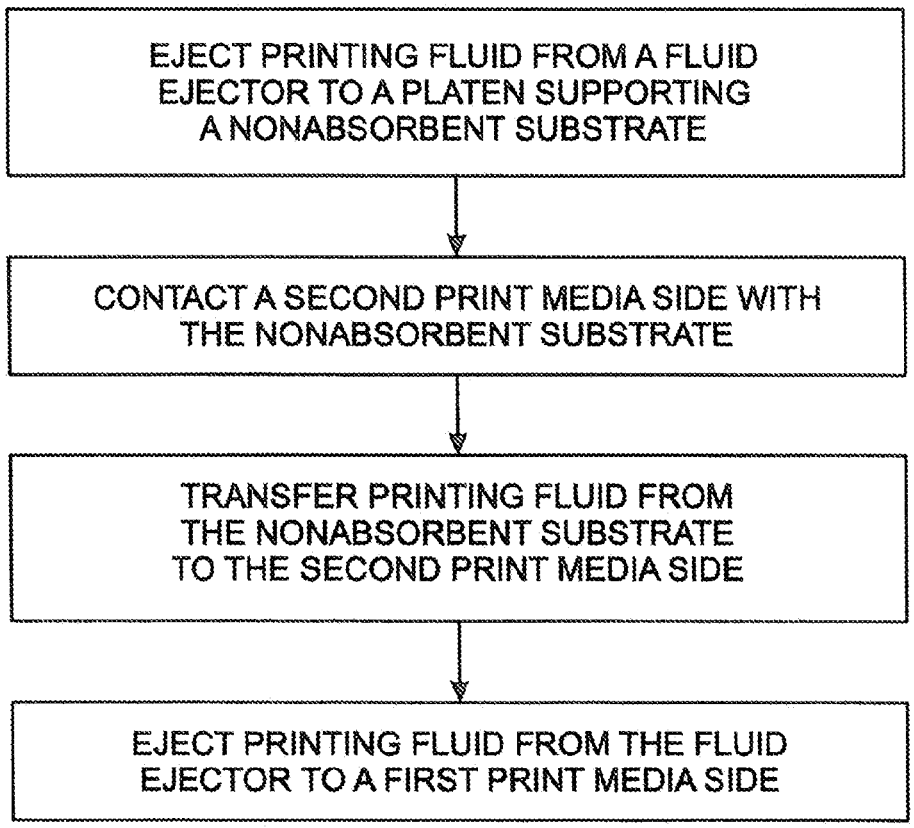
FIG. 4 is a flow diagram of a method for double-sided printing in accordance with the present disclosure.

For double-sided printing in accordance with the present disclosure, and in reference to FIG. 2, fluid may be ejected from fluid ejectors 15 onto nonabsorbent substrate 18 (when no print media is present) to form a reverse image on the nonabsorbent substrate. The received fluid image then may be transferred from nonabsorbent substrate 18 to sheet media S when sheet media S contacts the nonabsorbent substrate. As illustrated in FIGS. 2 and 3, the reverse-image (from nonabsorbent substrate 18) may thus be deposited as a forward-image 23 on a second side 24 of media sheet S. Further, in accordance to the present disclosure, placement of media sheet S on platen 16 and nonabsorbent substrate 18 may be in a defined relation to fluid ejectors 15, such that a forward-image 21 may be deposited on a first side 22 of media sheet S by fluid ejectors 15 once the media sheet S is on the platen.

In some examples, printing system 10 may form a part of a photo kiosk for use in depositing a photo image and date on media sheets. Referring to FIG. 3, first side 22 of media sheet S may be printed with a photo image 21. Second side 24 may be printed with a data image 23, including information such as the date the photo was taken or a graphic logo or other mark. Further, in some examples, the resolution of photo image 21 may be higher than data image 23. Therefore, in examples of printing system 10 forming a part photo kiosk, a printed photo may have a high quality photo image on one side, and simple, low resolution data image on the other side.

Referring to the example in FIG. 1, a method for double-sided printing is now described in detail. Fluid ejectors 15 may eject printing fluid to produce a reverse-image on nonabsorbent substrate 18 as platen 16 passes underneath (or as the fluid ejectors pass there over). An input device, including any conventional print media source, may then deposit print media on platen 16, such that first side 22 of media sheet S may be exposed to fluid ejectors 15. Second side 24 of media sheet S may lie on platen surface 17 such that second side 24 is in contact with nonabsorbent substrate 18. By contacting second side 24 with nonabsorbent substrate 18, the received fluid image may then transfer from nonabsorbent substrate 18 to second side 24. Printing of first side 22 of media sheet S may occur after or simultaneous to the printing of second side 24.

If the combination of the nonabsorbent substrate 18 and the absorbance of print media is sufficient, than all of the printing fluid may transfer from nonabsorbent substrate 18 to print media, and nonabsorbent substrate 18 will be ready for the next print cycle. If the transfer of the printing fluid to print media is incomplete, such that residual printing fluid is left on nonabsorbent substrate 18, then a cleaning station 56 may be included in printing system 10 to clean the residual printing fluid from nonabsorbent substrate 18 prior to the next print cycle.

Printing of first side 22 and second side 24 of media sheet S may occur in any order. Further, a printing system according to the present disclosure may be of any conventional printing system construction, though the construction of a printing system may determine in what order the first and second sides of print media are printed. In some examples, and as described above in reference to FIG. 1, platen 16 may form a part of a shuttle and may pass underneath fluid ejector subsystem 12 in a defined fluid receptive relationship. Alternatively, according to other conventional printing system construction, fluid ejector subsystem 12 may form a part of a scanning carriage configured to pass over platen 16 in defined relation, such that a fluid image may be ejected onto print media retained by platen 16 and/or nonabsorbent substrate 18 supported by platen 16.

FIGS. 5-8 illustrate further examples of printing systems, wherein the printing systems may include an input device including a pick plate 40, generally configured to select print media, such as a media sheet, from a stack and place it on a platen 34. Platen 34 may include a recessed area 35 configured to support nonabsorbent substrate 36. Nonabsorbent substrate 36 may be secured in the recessed area 35 of platen 34 by any suitable means of attachment, such as adhesion. Platen 34 may further include retention means, such as vacuum ports 44, to retain print media 38 on platen 34.

Figure 5:
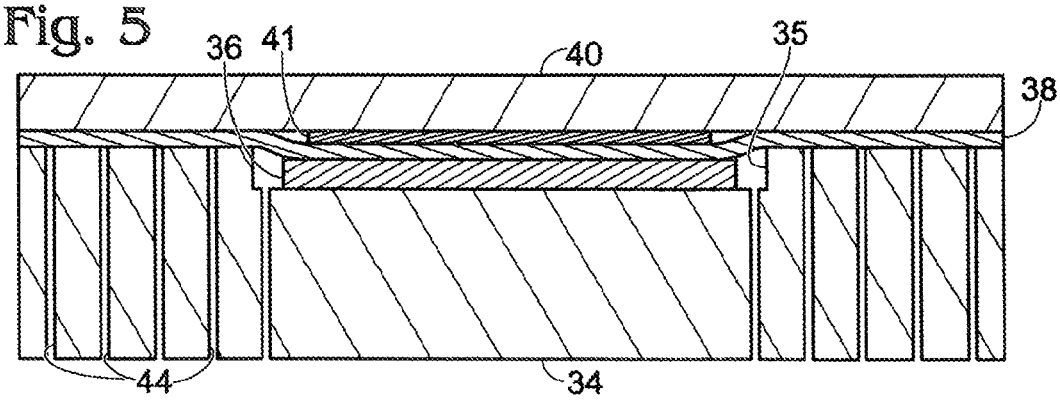

In accordance with the present disclosure, pick plate 40 may be configured to increase contact between print media 38 and nonabsorbent substrate 36. Referring to FIG. 5, pick plate 40 may include a fixed feature 41 configured to uniformly press print media 38 against nonabsorbent substrate 36. Alternatively, as seen in FIGS. 6-8, pick plate 40 may include a raised feature 42, integral with pick plate 40, configured to uniformly press print media 38 against nonabsorbent substrate 36.

Figure 6:
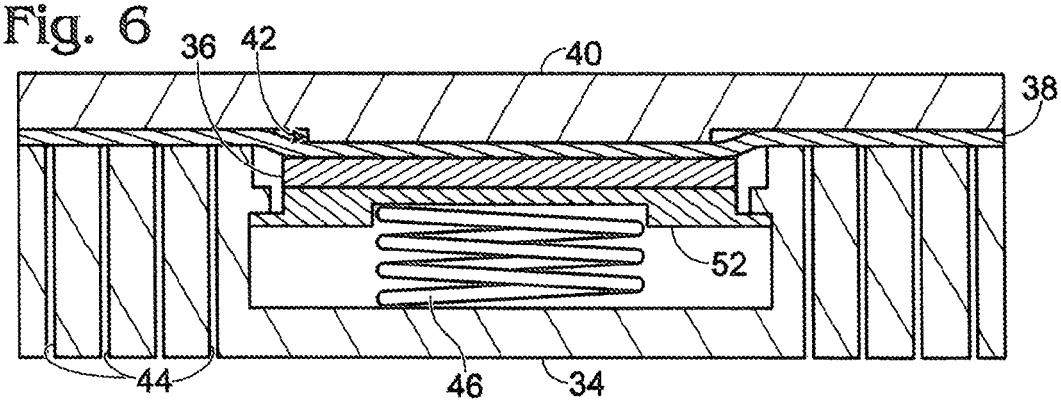

Referring to FIG. 6, some examples of platen 34 may include an active member 52 and compliant material, such as a spring 46, uniformly buoying active member 52. Active member 52 and spring 46 may be configured to uniformly support nonabsorbent substrate 36 such that nonabsorbent substrate 36 may press firmly against raised feature 42 of pick plate 40. Further, platen 34 may be configured to limit the range of vertical movement of active member 52, such that nonabsorbent substrate 36 does not rise substantially beyond platen 34.

Figure 7:
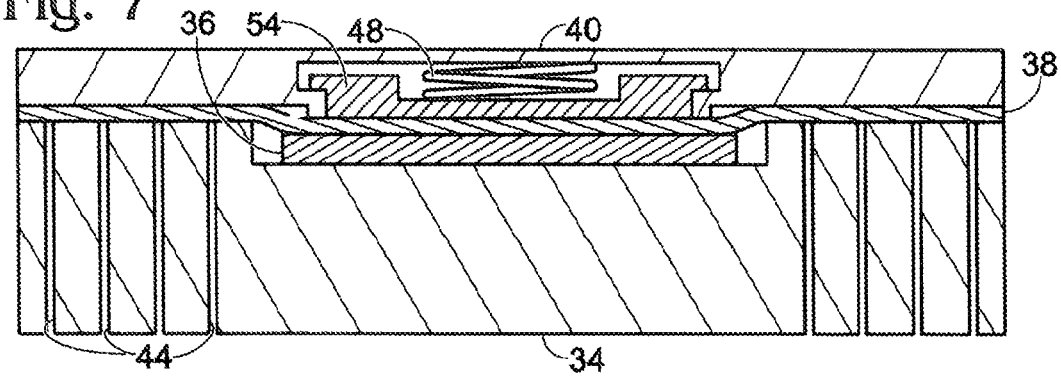
Figure 8:
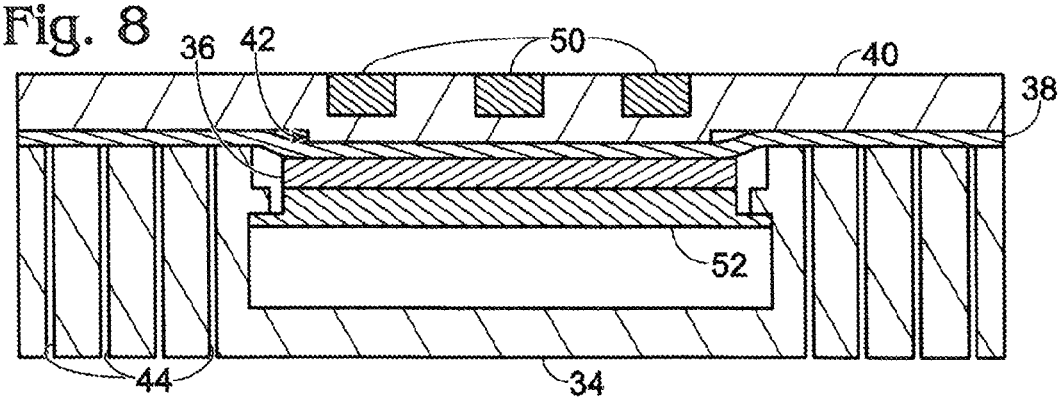

Alternatively, referring to FIG. 7, pick plate 40 may include an active member 54 and compliant material, such as a spring 48. Similarly, active member 54 and compliant material 48 may be configured to uniformly bear down on nonabsorbent substrate 36 such that nonabsorbent substrate 36 may press firmly against print media 38. In other examples, and in reference to FIG. 8, pick plate 40 may include one or more magnets 50, evenly distributed to attract an active member 58 of opposite polarity. Active member 58 may support nonabsorbent substrate 36 such that active member 58 and magnets 50 may uniformly compress nonabsorbent substrate 36 against pick plate 40.

It is believed that the disclosure set forth above encompasses multiple distinct embodiments of the invention. While each of these embodiments has been disclosed in specific form, the specific embodiments thereof as disclosed and illustrated herein are not to be considered in a limiting sense as numerous variations are possible. The subject matter of this disclosure thus includes all novel and non-obvious combinations and subcombinations of the various elements, features, functions and/or properties disclosed herein. Similarly, where the paragraphs recite "a" or "a first" element or the equivalent thereof, such paragraphs should be understood to include incorporation of one or more such elements, neither requiring nor excluding two or more such elements.

What is claimed is:

1. A method for double-sided printing comprising:

ejecting printing fluid from a fluid ejector to a platen configured to receive print media, the platen supporting a nonabsorbent substrate;

ejecting printing fluid from the fluid ejector to a first print media side; and contacting a second print media side with the nonabsorbent substrate to transfer printing fluid from the nonabsorbent substrate to the second print media side.

2. The method for double-sided printing of claim 1, wherein ejecting printing fluid to the platen and ejecting printing fluid to the first print media side occurs via an inkjet printhead.

3. The method for double-sided printing of claim 1, wherein contacting the second print media side with the nonabsorbent substrate occurs prior to ejecting printing fluid from the fluid ejector to the first print media side.

4. The method for double-sided printing of claim 1, wherein the second print media side contacts the nonabsorbent substrate in a plane.

5. The method for double-sided printing of claim 1, further comprising suctioning print media to the platen to increase transfer of printing fluid from the nonabsorbent substrate to the second print media side.

6. The method for double-sided printing of claim 1, further comprising pressing print media to the platen to increase transfer of printing fluid from the nonabsorbent substrate to the second print media side.

7. The method for double-sided printing of claim 1, wherein ejecting printing fluid from a fluid ejector to the nonabsorbent substrate includes date information in a reverse image.

8. The method for double-sided printing of claim 1, wherein printing fluid ejects from the fluid ejector to the first print media side at a first resolution, and printing fluid contacts the second print media side at a second resolution and, further wherein, the first resolution is higher than the second resolution.

9. The method for double-sided printing of claim 1, further comprising cleaning the nonabsorbent substrate.

10. The method for double-sided printing of claim 1, wherein printing fluid ejects to the platen in a reverse image, and printing fluid ejects to the first print media side in a forward image.

11. A double-sided printing system comprising:

a fluid ejector to eject a printing fluid onto a first side of a print media;

a platen configured to receive print media for printing by the fluid ejector; and a nonabsorbent substrate supported by the platen, the nonabsorbent substrate configured to receive printing fluid from the fluid ejector and to transfer received printing fluid to a second side of the print media.

12. The printing system of claim 11, wherein the nonabsorbent substrate is Teflon.

13. The printing system of claim 11, wherein the fluid ejector is an inkjet printhead.

14. The printing system of claim 11, wherein the nonabsorbent substrate substantially covers the platen.

15. The printing system of claim 11, wherein the nonabsorbent substrate is planar.

16. The printing system of claim 11, wherein the platen includes vacuum ports configured to suction print media to the nonabsorbent substrate to increase contact between print media and the nonabsorbent substrate.

17. The printing system of claim 11, further comprising a pick mechanism configured to increase contact between the nonabsorbent substrate and print media.

18. The printing system of claim 11, further comprising a cleaning station to clean the nonabsorbent substrate.

19. The printing system of claim 11, wherein the printing system forms a part of a photo kiosk.

20. A printing system for printing on print media having first and second sides, the system comprising:

platen means for receiving print media, the platen means defining a nonabsorbent substrate fluid ejection means for ejecting printing fluid onto the nonabsorbent substrate to form a reverse-image thereon prior to placement of print media on the platen means for ejecting printing fluid onto a first side of print media after placement of print media on the platen means; and contact means for transferring printing fluid from the nonabsorbent substrate onto to the second side of the print media.

* * * * *

UNITED STATES PATENT AND TRADEMARK OFFICE

CERTIFICATE OF CORRECTION

PATENT NO. : 8,100,489 B2
APPLICATION NO. : 12/253388
DATED : January 24, 2012
INVENTOR(S) : Dale D. Timm, Jr. et al.

It is certified that error appears in the above-identified patent and that said Letters Patent is hereby corrected as shown below:

On the Title page, in Item (75), Inventors, in column 1, line 5, delete "Baslani," and insert -- Bastani, --, therefor.

Signed and Sealed this
Sixteenth Day of October, 2012

David J. Kappos

David J. Kappos
*Director of the United States Patent and Trademark Office*